US009938979B2

(12) United States Patent
Nanba et al.

(10) Patent No.: US 9,938,979 B2
(45) Date of Patent: Apr. 10, 2018

(54) CENTRIFUGAL PUMP

(71) Applicant: DENSO CORPORATION, Kariya, Aichi-pref. (JP)

(72) Inventors: Kunio Nanba, Anjo (JP); Yuta Hasebe, Obu (JP)

(73) Assignee: DENSO CORPORATION, Kariya (JP)

( * ) Notice: Subject to any disclaimer, the term of this patent is extended or adjusted under 35 U.S.C. 154(b) by 277 days.

(21) Appl. No.: 14/830,960

(22) Filed: Aug. 20, 2015

(65) Prior Publication Data

US 2016/0138599 A1 May 19, 2016

(30) Foreign Application Priority Data

Nov. 13, 2014 (JP) ..... 2014-230368

(51) Int. Cl.

| | |
|---|---|
| ***F04D 29/24*** | (2006.01) |
| ***F04D 17/10*** | (2006.01) |
| ***F04D 29/30*** | (2006.01) |
| ***F04D 29/22*** | (2006.01) |

(52) U.S. Cl.

CPC ..... *F04D 17/10* (2013.01); *F04D 29/2255* (2013.01); *F04D 29/242* (2013.01); *F04D 29/30* (2013.01)

(58) Field of Classification Search

CPC .... F04D 29/2255; F04D 29/242; F04D 29/30; F05D 2240/301

See application file for complete search history.

(56) References Cited

U.S. PATENT DOCUMENTS

| | | | | |
|---|---|---|---|---|
| 3,788,765 A * | 1/1974 | Rusak | F04D 29/284 415/224.5 |
| 4,253,798 A * | 3/1981 | Sugiura | F04D 29/2255 415/204 |
| 5,290,236 A * | 3/1994 | Mathewson | A61M 1/101 415/206 |
| 6,030,188 A | 2/2000 | Nojiri et al. | |
| 6,769,876 B2 * | 8/2004 | Sakai | F01D 1/02 415/206 |

FOREIGN PATENT DOCUMENTS

| | | |
|---|---|---|
| JP | 2002-122095 | 4/2002 |
| JP | 2004-278311 | 10/2004 |
| JP | 2005-23794 | 1/2005 |
| JP | 2007-239674 | 9/2007 |

* cited by examiner

*Primary Examiner* — Ninh H Nguyen
(74) *Attorney, Agent, or Firm* — Nixon & Vanderhye PC

(57) ABSTRACT

A centrifugal pump for pressurizing fluid by using centrifugal force has an impeller and a casing. The impeller is operated rotatably by an actuator. The casing houses the impeller. The impeller has blades arranged one after another in a circumferential direction of the impeller, and a passage is defined between the blades adjacent to each other in the circumferential direction. The passage has a linear portion and a curved portion. The linear portion extends linearly and has a uniform cross section. The curved portion is connected to an end of the linear portion, extends as being curved to a radial-outer side of the impeller, and decreases in cross section toward the radial-outer side.

4 Claims, 3 Drawing Sheets

CENTRIFUGAL PUMP

CROSS REFERENCE TO RELATED APPLICATION

This application is based on Japanese Patent Application No.2014-230368 filed on Nov. 13, 2014, the disclosure of which is incorporated herein by reference in its entirety.

TECHNICAL FIELD

The present disclosure relates to a centrifugal pump for pressurizing fluid by using centrifugal force.

BACKGROUND

Conventionally, a centrifugal pump has an impeller and a casing. An actuator such as an electric motor operates the impeller rotatably, and the casing houses the impeller. The impeller has blades arranged one after another in a circumferential direction, and the blades define a passage for pressurizing fluid. Specifically, in a low-specific-speed centrifugal pump, it is well-known that the passage is curved spirally toward an outer peripheral side, and a cross section of the passage decreases toward the outer peripheral side (refer JP 2002-122095 A and JP 2005-023794 A, for example).

That is, according to such a centrifugal pump, fluid flows out of the impeller after passing through the passage while velocity energy of the fluid is changed into pressure energy. Accordingly, the centrifugal pump may have a preferable configuration as a low-specific-speed type since the fluid can be pressurized with less friction loss.

However, since the passage is curved, a passage length from an inlet to an outlet becomes long, and a swirl flow can be caused easily by a separated flow. The swirl flow may cause noises. In addition, saving energy is a trend in these days, and it is required that a torque applied to the impeller is reduced and that a rotation speed of the impeller increases. As a result, the separated flow may be occurred easily and noise can be caused easily.

SUMMARY

The present disclosure addresses the above issues, and it is objective of the present disclosure to provide a centrifugal pump with which noise can be suppressed.

A centrifugal pump of the present disclosure is for pressurizing fluid by using centrifugal force. The centrifugal pump has an impeller and a casing. The impeller is operated rotatably by an actuator. The casing houses the impeller. The impeller has blades arranged one after another in a circumferential direction of the impeller, and a passage is defined between the blades adjacent to each other in the circumferential direction. The passage has a linear portion and a curved portion. The linear portion extends linearly and has a uniform cross section. The curved portion (i) is connected to an end of the linear portion, (ii) extends as being curved to a radial-outer side of the impeller, and (iii) decreases in cross section toward the radial-outer side.

According to the centrifugal pump of the present disclosure, since the passage has the linear portion having the uniform cross section, a passage length of the passage can be shortened, and an area in which a swirl flow occurs easily by a separated flow can be reduced.

Further, since the linear portion is connected with the curved portion that decreases in cross section toward the radial-outer side, velocity energy of the fluid can be certainly changed into pressure energy. As a result, in the centrifugal pump, especially, in a low-specific-speed centrifugal pump, noise can be suppressed.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION (Embodiment)

An embodiment of the present disclosure will be described hereafter. However, it should be noted that the embodiment is an example of the present disclosure, and the present disclosure is not limited to the embodiment.

A configuration of a centrifugal pump 1 of the present embodiment will be describes referring to FIGS. 1 to 4. The centrifugal pump 1 pressurizes fluid by using centrifugal force caused by a rotation. For example, the centrifugal pump 1 draws fluid around a rotation axis toward one side in an axial direction of the rotation axis, guides the fluid to a radial-outer side, and discharges the fluid in a circumferential direction. The fluid is pressurized as being guided to the radial-outer side. The centrifugal pump 1 has an impeller 2 and a casing 3. The impeller 2 is operated rotatably by an electric motor (not shown), and the casing 3 houses the impeller 2.

Figure 1:
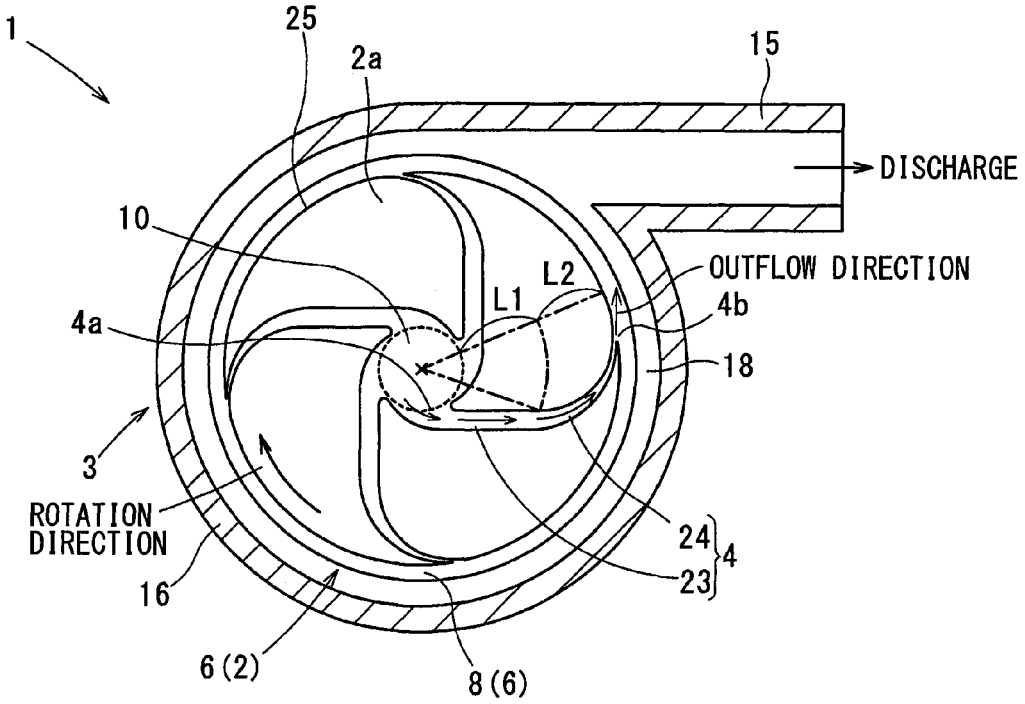
FIG. 1 is an explanatory diagram illustrating a cross section of a centrifugal pump taken along a line perpendicular to an axial direction regarding to an embodiment.
Figure 2:
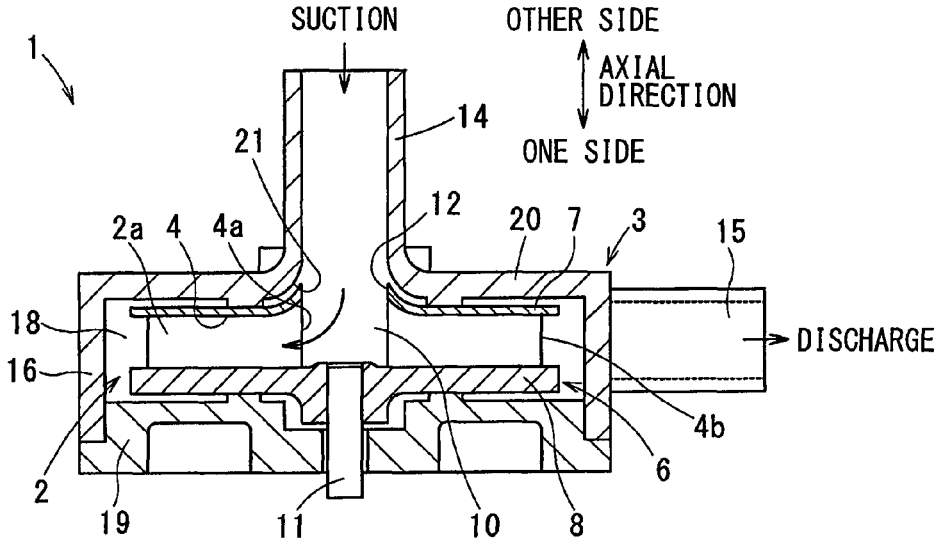
FIG. 2 is a cross-sectional view illustrating the centrifugal pump and taken along the axial direction regarding to the embodiment.
Figure 3:
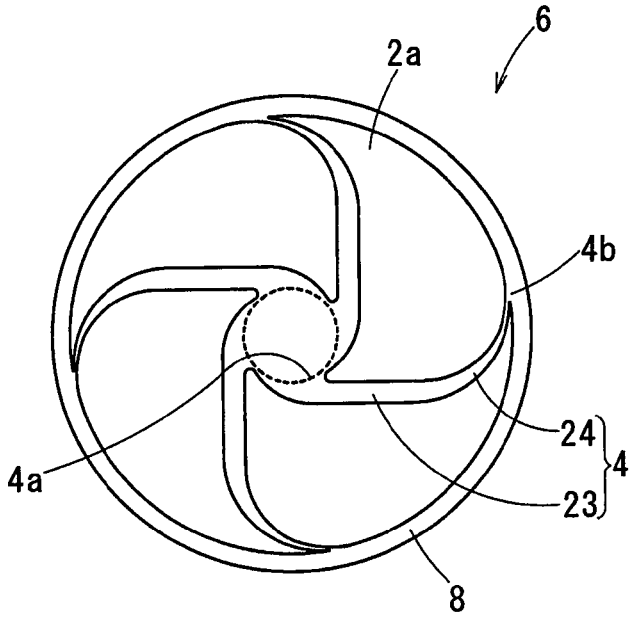
FIG. 3 is a plane view illustrating an impeller regarding to the embodiment.
Figure 4:
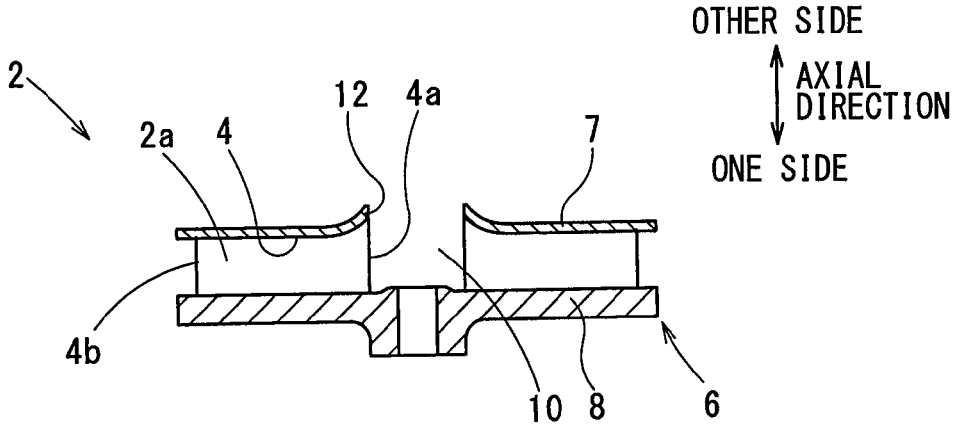
FIG. 4 is a cross-sectional view illustrating the impeller and taken along the axial direction regarding to the embodiment.
Figure 5:
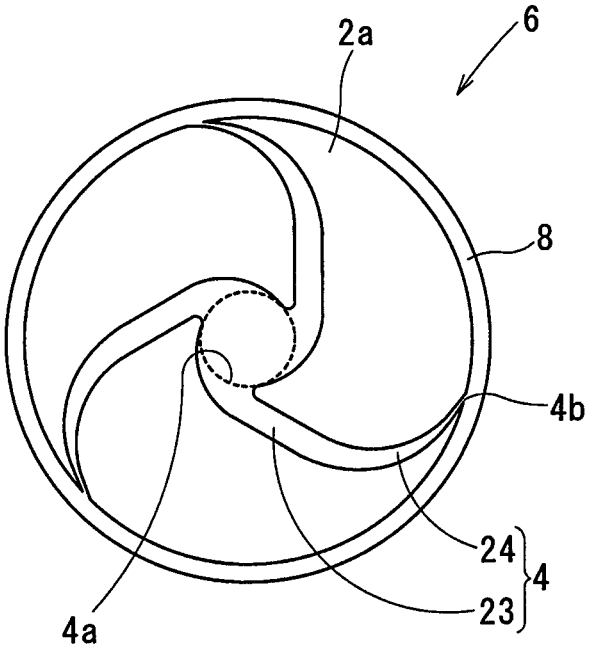
FIG. 5 is a plane view illustrating an impeller regarding a modification example.

The impeller 2 defines a passage 4 for pressurizing fluid by centrifugal force. Specifically, the impeller 2 has blades 2*a* that are arranged one after another in the circumferential direction. The blades 2*a* are distanced from each other in the circumferential direction, and the passage 4 is defined between the blades 2*a* adjacent to each other in the circumferential direction. Each blade 2*a* has an outer peripheral edge having an arc shape in a plane view, and the impeller 2 has a circular shape in a plane view, as shown in FIG. 1. The blade 2*a* is disposed to a main plate 6, and the main plate 6 and a side plate 7 are coupled by a method such as welding to form the impeller 2. The main plate 6 is located on the one side in the axial direction with respect to the blade 2*a*, and the side plate 7 is located on the other side in the axial direction with respect to the blade 2*a*. The passage 4 is closed by a bottom portion 8 of the main plate 6 on the one side and is closed by the side plate 7 on the other side in the axial direction.

The impeller 2 defines a passage 10 around the rotation axis, and the passage 10 introduces fluid to an inlet port 4*a* of the passage 4. The passage 10 is defined coaxially with an output shaft 11 of the electric motor. The passage 10 is defined in the main plate 6 by an inner periphery of the blades 2*a* and has a generally tubular shape. Fluid flows into the passage 10 from a through hole 12 that is defined in the side plate 7 to pass through the side plate 7 and that has a circular shape.

The casing 3 has an inlet portion 14, an outlet portion 15, and an outer wall (i.e., a peripheral wall) 16. The inlet portion 14 has a suction port from which fluid is drawn, and the outlet portion 15 has an outlet port from which the fluid is discharged. The outer wall 16 has a tubular shape and is located on the radial-outer side of the impeller 2 to cover an outer periphery of the impeller 2. For example, the casing 3 is configured seamlessly.

The inlet portion 14 protrudes from the other side of the casing 3 in the axial direction and is coaxially with the output shaft 11. The outlet portion 15 protrudes radial-outward from the outer wall 16 in a radial direction of the outer wall 16 that is perpendicular to the axial direction. The outer wall 16 is coaxially with the impeller 2, and an annular passage 18 is defined between the outer wall 16 and a radial-outer periphery of the impeller 2. The outer wall 16 is closed on the one side in the axial direction by a cover 19 that is disposed separately from the casing 3. The outer wall 16 is closed on the other side in the axial direction by a side wall 20 that is molded integrally with the outer wall 16.

The output shaft 11 passes through the cover 19 and extends into the casing 3. The output shaft 11 is fixed to the main plate 6 in the casing 3. The inlet portion 14 protrudes from the other side of the side wall 20 in the axial direction. The side wall 20 has a through hole 21, and a fluid passage defined in the inlet portion 14 and the passage 10 communicates with each other through the through hole 21. An inner periphery of the side plate 7 defining the through hole 12 has a tapered shape such that an inner diameter of the inner periphery decreases toward the other side in the axial direction. An inner periphery of the side wall 20 defining the through hole 21 also has a tapered shape such that an inner diameter of the inner periphery decreases toward the other side in the axial direction. Accordingly, fluid drawn from the inlet portion 14 can smoothly flow into the passage 4 through the passage 10.

The fluid flowing into the passage 4 through the passage 10 is pressurized by centrifugal force while passing through the passage 4 and is discharged from the outlet portion 15 after flowing through the passage 18.

Structural features of the centrifugal pump 1 will be described.

The passage 4 has a linear portion 23 and a curved portion 24. The linear portion 23 has a uniform cross section and extends linearly. The curved portion 24 is connected to an end of the linear portion 23 and extends from the end of the linear portion 23 to the radial-outer side of the impeller 2. The curved portion 24 decreases in cross section toward the outer peripheral side. In the present embodiment, four of the passages 4 are defined around the rotation axis of the impeller 2 at 90° intervals.

The linear portion 23 is connected with the inlet port 4*a* of the passage 4 and is open in the passage 10. Specifically, the linear portion 23 is connected to the passage 10 in a tangential direction in a plane view.

The curved portion 24 is smoothly connected to the end of the linear portion 23 and has the curved shape (i.e., a spiral shape) in a plane view. The curved portion 24 has an opening portion that is open on the radial-outer side (i.e., in the radial-outer periphery) of the impeller 2, and the opening portion defines an outlet port 4*b* of the passage 4.

When a circle 25 is defined by an outer peripheral edge of the impeller 2, the curved portion 24 is inscribed in the circle 25 at the outlet port 4*b*. A flow direction of fluid flowing from the outlet port 4*b* is opposite to the rotation direction of the impeller 2. That is, the fluid flows out of the passage 4 into the passage 18 in a tangential direction of the circle 25 at the outlet port 4*b*. A passage width of the curved portion 24 decreases toward the radial-outer side in the plane view such that a cross section of the curved portion 24 decreases toward the radial-outer side.

A projected length of the linear portion 23 in a radial direction of the impeller 2 is defined as a length L1, and a projected length of the curved portion 24 in the radial direction is defined as a length L2. A ratio of the length L1 to the length L2 is set within a range from two third to three second ($2/3 \leq (L1/L2) \leq 3/2$).

As described above, the centrifugal pump 1 of the present embodiment has the passage 4, and the passage 4 has the linear portion 23 and the curved portion 24. That is, the linear portion 23 has a uniform cross section and extends linearly. The curved portion 24 is connected to the end of the linear portion 23 and extends from the end to the radial-outer side. The curved portion 24 decreases in cross section toward the radial-outer side.

Accordingly, since the passage 4 has the linear portion 23 that is uniform in cross section, a total length of the passage 4 can be shortened, and an area in which a swirl flow is caused easily by a separated flow can be reduced.

Further, since the linear portion 23 is connected with the curved portion 24 of which cross section decreases toward the radial-outer side, velocity energy of fluid can be certainly changed into pressure energy. Accordingly, noise can be suppressed in the centrifugal pump 1, especially, in a low-specific-speed centrifugal pump.

Further, since the linear portion 23 is included in the passage 4, the passage length from the inlet port 4*a* to the outlet port 4*b* can be shortened, a friction loss can be reduced, and a motor efficiency can be improved. As a result, a diameter of the impeller 2 can be decreased, and the impeller 2 can be downsized.

Moreover, a flow direction of fluid flowing out of the passage 4 from the outlet port 4*b* is opposite to the rotation direction of the impeller 2. Therefore, since the fluid flows out of the impeller 2 at a speed that is close to the rotation speed of the impeller 2, noise can be suppressed more effectively.

(Other Modification)

Figure 6:
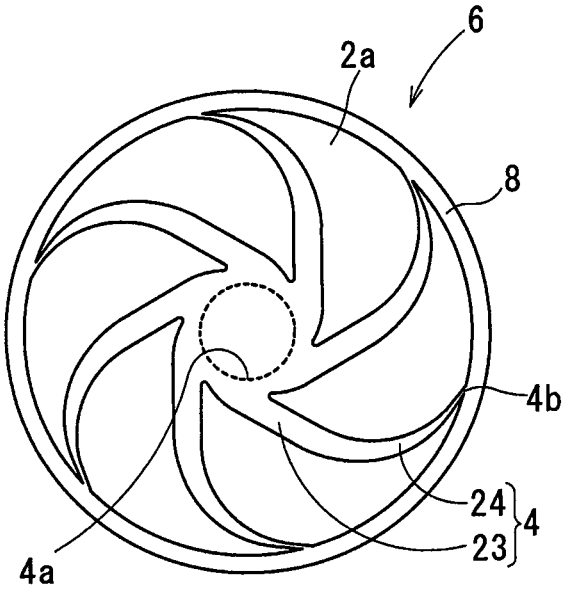
FIG. 6 is a plane view illustrating an impeller regarding a modification example.

The present disclosure is not limited to the above-described embodiment and can be modified as required. For example, in the above-described embodiment, the centrifugal pump 1 has the four passages 4. However, a quantity of the passages 4 is not limited and may be three. Alternatively, the quantity of the passages 4 may be six as shown in FIG. 6.

In the above-described embodiment, the passage 4 has the linear portion 23 that is connected to the passage 10 and the curved portion 24 that is connected to the passage 18. However, the passage 4 is not limited to have such a configuration. For example, a curved portion may be provided between the passage 10 and the linear portion 23. Alternatively, a linear portion may be connected to the curved portion 24 such that the linear portion is connected to the passage 18.

In the above-described embodiment, the passage width of the curved portion 24 decreases toward the radial-outer side in the plane view such that the curved portion 24 decreases in cross section toward the radial-outer side. However, a passage width of the curved portion 24 in the axial direction may decreases toward the radial-outer side such that the curved portion 24 decreases in cross section toward the radial-outer side.

Such changes and modifications are to be understood as being within the scope of the present disclosure as defined by the appended claims.

What is claimed is:

1. A centrifugal pump for pressurizing fluid by using centrifugal force, the centrifugal pump comprising:

an impeller operated rotatably by an actuator; and a casing housing the impeller, wherein the impeller has blades arranged one after another in a circumferential direction of the impeller, and a passage is defined between the blades adjacent to each other in the circumferential direction, and the passage has:

a linear portion extending linearly and having a uniform cross section; and a curved portion (i) connected to an end of the linear portion, (ii) extending as being curved to a radial-outer side of the impeller, and (iii) decreasing in cross section toward the radial-outer side, wherein the passage has an opening portion that is open on the radial-outer side of the impeller, and fluid after being pressurized flows from the opening portion, and the fluid flows from the opening portion in a direction that is opposite to a rotation direction of the impeller.

2. A centrifugal pump for pressurizing fluid by using centrifugal force, the centrifugal pump comprising:

an impeller operated rotatably by an actuator; and a casing housing the impeller, wherein the impeller has blades arranged one after another in a circumferential direction of the impeller, and a passage is defined between the blades adjacent to each other in the circumferential direction, and the passage has:

a linear portion extending linearly and having a uniform cross section; and a curved portion (i) connected to an end of the linear portion, (ii) extending as being curved to a radial-outer side of the impeller, and (iii) decreasing in cross section toward the radial-outer side, wherein a cross section of the curved portion is perpendicular to the axial direction of the impeller;

the cross section of the curved portion includes a first curved side having a first radius of curvature and a second curved side having a second radius of curvature; and the first radius of curvature and the second radius of curvature are different.

3. The centrifugal pump according to claim 2, wherein the first radius of curvature of the first side and the second radius of curvature of the second side are different at that part of the curved portion which is connected to the end of the linear portion.

4. The centrifugal pump according to claim 2, wherein

L1 represents a first length of the linear portion that is projected in a radial direction of the impeller, and L2 represents a second length of the curved portion that is projected in the radial direction, the first length L1 is smaller than the second length L2.

* * * * *